United States Patent [19]

Larson

[11] Patent Number: 4,606,535

[45] Date of Patent: Aug. 19, 1986

[54] SHEET FEEDING DEVICE

[75] Inventor: Bradley W. Larson, Garland, Tex.

[73] Assignee: The Mead Corporation, Dayton, Ohio

[21] Appl. No.: 677,110

[22] Filed: Nov. 30, 1984

[51] Int. Cl.[4] ..... B65H 3/04; B65H 3/52

[52] U.S. Cl. ..... 271/10; 271/35; 271/118; 271/124; 271/165

[58] Field of Search ..... 271/10, 34, 35, 37, 271/38, 121, 122, 124, 125, 110, 111, 165, 116, 118

[56] References Cited

U.S. PATENT DOCUMENTS 3,103,355 9/1963 Hubbard et al. ..... 271/34
3,869,117 3/1975 Yoshimura ..... 271/35
3,988,017 10/1976 Kyhl ..... 271/34
4,014,537 3/1977 Stange ..... 271/35
4,189,135 2/1980 Costa ..... 271/35

*Primary Examiner*—Bruce H. Stoner, Jr.
*Assistant Examiner*—Matthew C. Graham
*Attorney, Agent, or Firm*—Biebel, French & Nauman

[57] ABSTRACT

A sheet feeding device for feeding single sheets of paper from the bottom of a stack of paper sheets. The device includes a feed tray angled at approximately 60° with the horizontal and a substantially rigid paper drive member cooperating with a plurality of differentially yieldable retard members. By successively increasing the normal pressure on the members or by changing their coefficients of friction, increments of increasing or decreasing retarding force are provided. Uniform frictional forces between individual sheets are provided by a bail weight.

12 Claims, 9 Drawing Figures

SHEET FEEDING DEVICE

BACKGROUND OF THE INVENTION

The invention relates to copying machines and, more particularly, to sheet feeding devices for feeding sheets singly from a stack to a utilization device.

Both bottom level feeders, which feed single sheets from the bottom of a stack, and top level feeders, which feed the top sheet from a stack, as well known and are used extensively with copying machines. The feeding of single sheets from the bottom of a stack of sheets, while generally more difficult, is desirable in that additional sheets may be added to the stack during the feeding operation and the document order is preserved.

Many prior art sheet feeding devices utilize a flexible feed belt to draw the exterior or outermost sheet from a stack, and a substantially rigid retard member to prevent sheets adjacent to the exterior sheet from being simultaneously completely withdrawn and expelled from the stack. Examples of such feeders are Stange U.S. Pat. No. 3,768,803, which shows a top level feeder, and Stange U.S. Pat. No. 4,014,537, which shows a bottom level feeder. Both feeders utilize flexible drive belts and devices which act with the belt to allow only a single sheet to be fed at a time. The bottom level feeder utilizes air flotation to assist in sheet separation.

Many belt-type feed devices utilize retard pads which are made of a relatively high friction material and are positioned to engage the belt during feeder operation to form a pinch point which allows only a single sheet to pass through. An example of a retard pad is shown in Perun et al. U.S. Pat. No. 4,192,497. Other prior art patents disclosing bottom level sheet feeders are David U.S. Pat. No. 3,831,928, which discloses a rigidly supported drive belt and a rigid, pivotable, retard device; Strobel U.S. Pat. No. 3,934,869, which shows a flexible drive belt and rigid retard plus a flow of pressurized air against the bottom sheet to reduce friction between the bottom sheet and the sheet immediately thereabove, and Hamlin et al. U.S. Pat. No. 4,166,614, which shows the desirability of continuously applying an effective normal force to the top of widely variable size stacks for a bottom sheet feeder having a flexible drive belt and a rigid retard.

Sheet feed devices of the type previously described were often difficult to make reliable. Should a large number of sheets enter the pinch point formed by the belt and retard pad, they became shingled by the shearing force exerted by the moving belt, and forced the belt and retard apart. This gap became so large that sheets spaced from the retard pad would be conveyed past the pinch point along with the sheet contacting the belt, a condition known as "multifeed." Multifeeds may be reduced in frequency of occurrence by increasing the force exerted between the belt and pad. However, increasing the pinching force at the pinch point may result in a condition known as "misfeed," in which no sheet is passed through the pinch point; or it may damage the sheet fed.

Accordingly, there is a need for a sheet feeding device which feeds sheets singly from a stack with a minimum amount of multifeeds or misfeeds. There is also a need for a sheet feeding device which maintains a pinch point in response to contact with a large number of sheets such that multifeeds are prevented, and yet does not damage sheets passing through the pinch point.

SUMMARY OF THE INVENTION

The invention is a bottom level sheet feeding device which minimizes the likelihood of sheet misfeeds and sheet multifeeds. The feeder comprises a downwardly-angled drive belt and a tray for supporting a stack of sheets on the drive belt. The drive belt pulls the lowermost sheets from the stack and separates them from each other by pulling them beneath a plurality of independently yieldable retard members. A rigid backup member supports the drive belt and prevents its deflection by the retard members.

In a preferred embodiment there are six retard members, each independently spring-loaded and having a lower end made of a friction material. This material may be varied from element to element so that the six members provide a collective retard pad with a coefficient of friction that varies along its length to provide an optimal coefficient of friction profile. Another advantage of the sheet feeding device is that the lead or first retard member encountered by a sheet may be adjusted to have a relatively light spring load to assure that the retard member does not damage the sheet, while the last or trailing retard members may be adjusted to have a relatively heavy spring load to avoid a multifeed condition.

Furthermore, because each element of the retard is individually suspended, the trailing retard members are not affected by the lifting of the leading retard members from the belt by a wedge of sheets from the stack. This also minimizes the likelihood of feeding more than one sheet past the retard member.

Accordingly, it is an object of the present invention to provide an improved sheet feeding device having a substantially rigid paper-driving member and a multiple element retard with independently yieldable elements; a sheet feeding device which minimizes the likelihood of multifeeds or misfeeds; and a sheet feeding device which feeds sheets singly from a stack of sheets without damaging the sheets that are fed.

Other objects and advantages of the invention will become apparent from the following description, the accompanying drawings and the appended claims.

DESCRIPTION OF THE PREFERRED EMBODIMENTS

Figure 1:
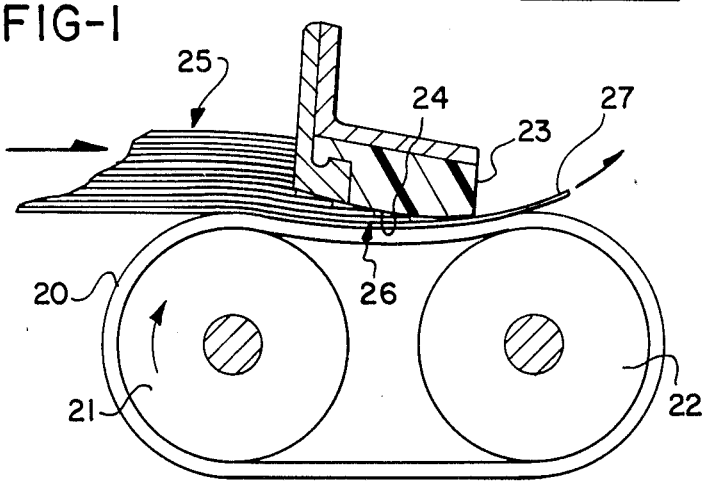
PRIOR ART FIG-1
FIG. 1 is a schematic side elevation illustrative of a typical prior art flexible belt drive and rigid retard system.
Figure 2:
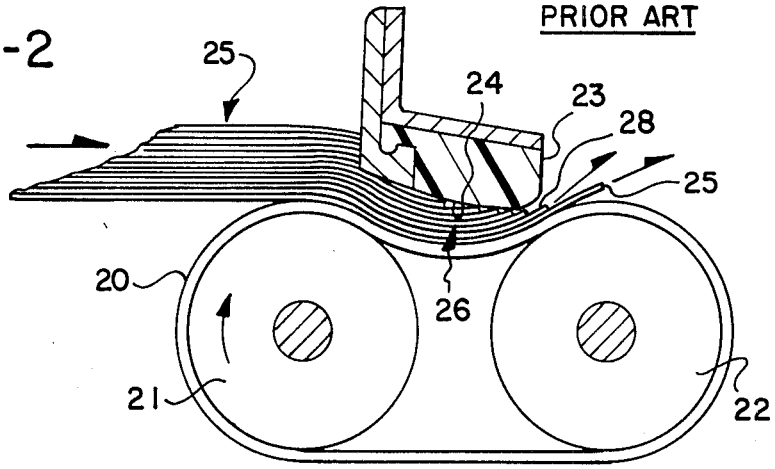
PRIOR ART FIG-2
FIG. 2 is a schematic side elevation illustrating a typical malfunction of the belt drive and retard system of FIG. 1.

Typical prior art belt drive and retard mechanisms of the friction retard type are shown in FIGS. 1 and 2. Flexible drive belt 20 is loosely suspended between driven and driving rollers 21, 22, respectively, so that it will conform to the contour of rigid retard member 23. Retard member 23 is a unitary structure having a convex surface 24 which contacts the belt 20. Belt 20 has a surface providing a high coefficient of friction with paper. The coefficient of friction of the retard 23 on paper is lower than that of the drive belt 20 but higher than that between adjacent sheets in stack 25.

These conventional friction retard designs are difficult to make reliable. This is particularly so when the weight, surface roughness, and condition of the document being separated varies. Ideally, as illustrated in FIG. 2, the flexible belt 20 wraps around and conforms to the retard pad surface 24. As the belt moves, the retard 23 operates by shingling a small portion of the stack 25 that enters the pinch point 26 formed between the retard 23 and the belt 20. More sheets enter this pinch point 26, the belt 20 deflects away from the retard 23 to accommodate them, which allows a longer train of shingled sheets to form under the retard.

Figure 3:
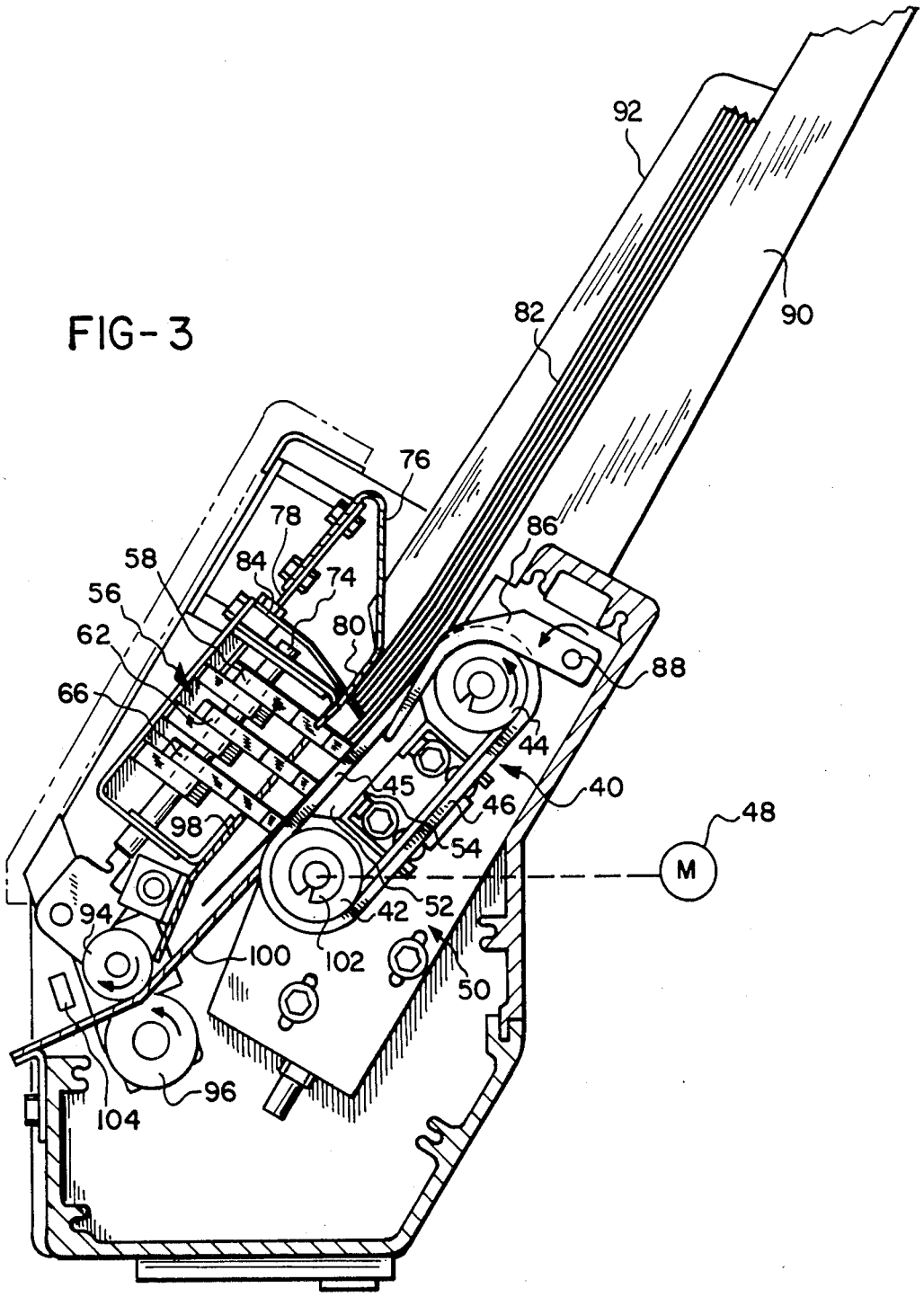
FIG. 3 is a schematic side elevation in section illustrating a preferred embodiment of the sheet feed device.

As long as this train of shingled sheets is shorter than the length of the convex surface 24 of the retard 23, then only a single sheet 27 will feed, as illustrated in FIG. 2. Multifeed failures occur when the belt 20 deflects too far from the surface 24 of the retard 23, as shown in FIG. 3. This is because the gap between the belt 20 and the retard surface 24 is so large that a second sheet 28 away from the belt never contacts the surface 24. Sheet 28 feeds out of the device along with the sheet 28 contacting the belt 20.

The likelihood of a multifeed can be reduced by increasing the normal force between the belt 20 and the retard 23. This will simultaneously increase the distance over which the retard surface 24 is active, and reduce the number of sheets which can wedge under the retard 23. Although the frequency of multifeeds will be reduced by this action, the likelihood of a misfeed will be increased. This is because the lead edges of the documents will be pressed deeper into the compliant retard surface 24 and an additional shearing force will be required to urge them forward against the retard material. Damage to the documents can also occur when the documents are pressed too strongly into the retard 23. Often a misfeed and damage to the document occurs together. Consequently, a conventional friction retard such as that shown in FIGS. 1 and 2 must employ a set of parameters which compromise between misfeed and multifeed failures. Because of document variability (size, weight, surface, composition), the friction retard has been somewhat unreliable. It is used often, however, because of its simplicity and low cost.

Figure 4:
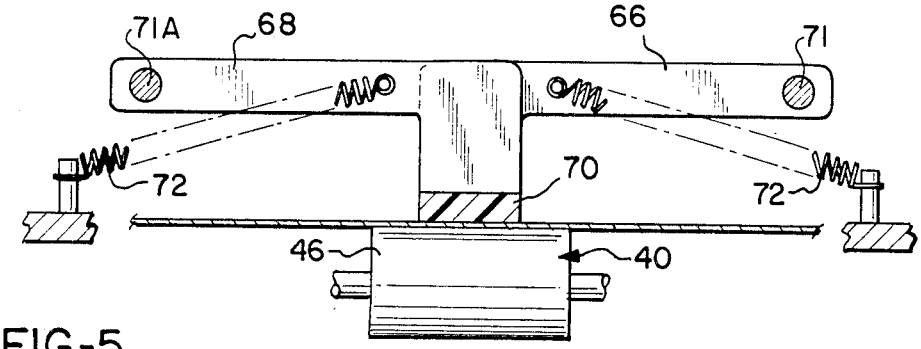
FIG. 4 is a schematic detail showing an end elevation of the belt and retard members of the device of FIG. 3.
Figure 5:
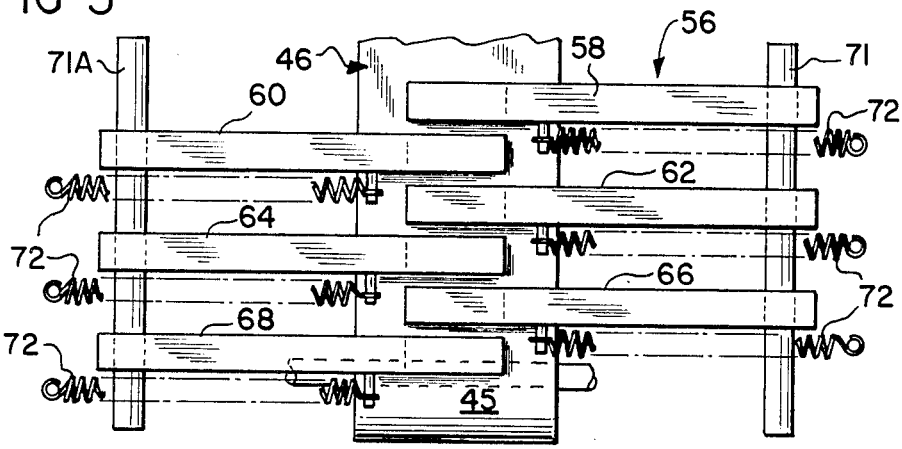
FIG. 5 is a schematic detail of a top plan view showing the belt and retard members of FIG. 4.

A preferred embodiment of the invention is shown in FIGS. 3, 4 and 5. The sheet feeding device includes a belt drive assembly, generally designated 40, having a forward drive roller 42, a rearward driven roller 44, and an endless flexible belt 46 extending about the rollers. Roller 42 is driven by a motor 48, and the belt drive assembly 40 is mounted on a support housing, generally designated 50.

A back-up plate 52, made of a relatively low friction material such as polytetrafluoroethylene, is positioned between forward and rearward rollers 42, 44, respectively, and supports the upper run 45 of the belt 46. Back-up plate 52 is attached to a bracket 54 which is mounted on the support housing 50.

A retard device, generally designated 56, includes retard members 58, 60, 62, 64, 66 and 68. Each of the retard members 58–68 includes a retard shoe 70 made of a friction material. The retard members 58–68 are substantially L-shaped, with members 60, 64, 68 pivotally mounted on an axle 71, and members 58, 62, 66 pivotally mounted on axle 71A. Each of the retard members 58–68 is biased downwardly against the upper run 45 of belt 46 by springs 72. Springs 72 are anchored to an adjacent portion of the support housing 50. The retard shoes 70 of retard members 58–68 collectively form a pinch point 74 with the upper run 45 of the belt 46.

A bail weight 76 is mounted on a bracket 78 attached to the housing 50. Bail weight 76 acts as a leaf spring and includes a trailing end 80 which is biased downwardly to urge against a stack 82 of sheets conveyed by the belt 46. A front wall 84 is attached to the housing 50 and extends downwardly below the bail weight 76 to form a slight gap above the upper run 45 of the belt 46. The gap is sized to allow only a few sheets from the stack 82 to pass therethrough at one time.

A pair of arcuate fingers 86 (one of which is shown in FIG. 1) are attached to an axle 88 which is pivotally mounted on the frame 50, and is rotatable by a solenoid (now shown). The fingers 86 can be actuated to rotate in a clockwise direction, as shown in FIG. 1, to raise a forward portion of the stack 82 away from the belt drive assembly 40 so that it does not contact the moving belt 46. This configuration is desirable during loading and unloading of stacks of sheets. Alternately, the solenoid can rotate the fingers 86 in a counterclockwise direction which allows the leading edge of the stack 82 to contact the belt 46.

The stack 82 is supported by a tray 90 having edge guides 92 (one of which is shown). The tray 90 and guides 92 are attached to the housing 50.

A pair of pinch rollers 94, 96 are positioned downstream of the belt drive assembly 40 and retard device 56, and are rotatably mounted to the housing 50. At least one of the rollers 94, 96 is driven by a motor (not shown). Upper and lower guides 98, 100 extend between the pinch rollers 94, 96 and belt drive assembly 40, so that a sheet passing through the belt drive assembly is guided to the nip of the pinch rollers. The pinch rollers grasp a sheet and convey it onwardly to the remainder of the associated copying machine for further processing.

The coefficient of friction between the shoes 70 and a sheet of paper from the stack 82 must exceed the coefficient of friction between individual sheets of the stack. The coefficient of friction between the belt 46 and paper must be greater than that between the retard shoes 70 and a sheet of paper. Preferably, the coefficient of friction between the retard shoes 70 and a sheet of paper is approximately twice that between individual sheets, and the coefficient of friction between the belt 46 and a sheet of paper is approximately twice that between the retard shoes and paper.

In order to minimize the effect of the weight of a stack of the force required to slide sheets of the stack relative to each other, the tray 90 is inclined to the horizontal. It has been found that inclination angles between about 50° to about 70° result in satisfactory performance. An inclination of approximately 60° has been found to produce a feed operation with a minimum amount of misfeed and nonfeed occurrences and is preferred. Angles greater than approximately 70° inhibit the ability of the sheets to maintain themselves in a stack; while inclinations shallower than about 50° result in an increase in the frictional force between sheets of the stack causing a frictional coupling which is unacceptable. When the tray 90 is oriented as shown in FIG. 1, the trailing end 80 of the bail weight 76 becomes the controlling factor in regulating the normal force applied between document sheets.

Forward drive roller 42 is provided with an overrunning clutch 102, which allows the trailing edge of a sheet conveyed by the belt 46 to rotate the belt freely as it is pulled forward by the pinch rollers 94, 96. A sensor 104 is attached to the housing 50 at a location downstream of the pinch rollers 94, 96. Sensor 104 detects the presence of a sheet downstream of the pinch rollers 94, 96 and actuates the solenoid which positions the fingers 86 and clutch 102. When a sheet passes through the pinch rollers, the solenoid is de-energized to allow the fingers to pivot upwardly, and the clutch is de-energized to disengage the belt drive assembly 40 from the motor 48.

In operation, a stack 82 of sheets is placed upon the tray 90 so that the lateral edges thereof lie against the guides 92. The leading edges of the sheets rest against the front wall 84 and are urged downwardly against the fingers 86 by the trailing end 80 of the bail weight 76. When the feeding sequence is initiated, the motor 48 rotates the drive roller 42 which in turn drives the belt 46 of the belt drive assembly 40. The solenoid rotates the fingers 86 in a counterclockwise direction (as shown in FIG. 1) which lowers the forward portion of the stack 82 downwardly into contact with the belt 46.

The friction surface of the belt 46 engages a lowermost sheet of the stack 82 and drives it forwardly through the gap formed between the belt and front wall 84. Typically, due to intersheet frictional forces, several sheets are propelled forwardly through the gap with the lowermost sheet.

The lowermost sheet, and any sheets above it conveyed through the gap, then engage the shoes 70 of the retard members 58–68. The lowermost sheet, which remains in contact with the belt 46, is conveyed past the retard device 56, while any sheets above it which are not in contact with the belt are retained by frictional engagement with the shoes 70.

The leading edge of the lowermost sheet is conveyed by the belt drive assembly 40 through the upper and lower guides 98, 100 and to the pinch rollers 94, 96. The pinch rollers grab the leading edge of the sheet and convey it away from the feeding device for further processing. As that sheet passes beneath the sensor 104, the sensor detects the presence of the sheet and actuates the solenoid and clutch 102 so that the fingers 86 raise the stack 82 above the upper run 45 of the belt 46 thereby stopping the feeding process. The rollers 94, 96 draw the sheet from the retard device 56, and the overrunning clutch 102 of the forward drive roller 42 allows the pinch rollers to rotate the belt about the belt rollers 42, 44 as it pulls the lowermost sheet from the retard device 56.

If a second sheet enters the pinch point 74, the retard 40 will keep the second sheet from moving out with the first or lowermost sheet. This is because the frictional forces between the retard 40 and paper are greater than the frictional forces between sheets. Ideally, a third sheet would never enter very far into the pinch point 74; however, in practical devices, the normal forces on the retard must not be too great or paper damage and misfeeds occur. In the prior art devices, as previously explained, this is a very serious problem.

In this invention, by having a plurality of independent (decoupled) retarding members, the normal forces on each individual retard member may be kept relatively low since a stack-up of sheets under one member does not affect the characteristics of a following retard member. The number of individual members used in a retard now becomes a matter of balancing the degree of reliability desired against the degree of complexity accepted, which was not possible in prior art friction retard devices. In the embodiment of the invention being described in detail, a six element retard has been found to be substantially failure-free over wide ranges of documentary sheets fed into the separator. With a more normal uniformity of sheet materials, three differential elements in the retard (as will be further described) have been found to be satisfactory.

Figure 6:
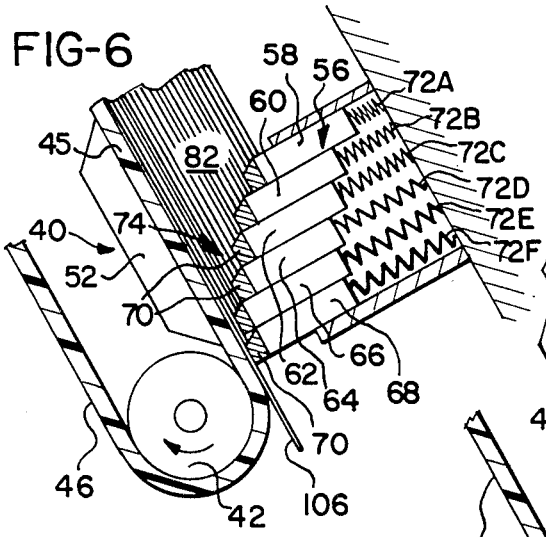
FIG. 6 is a detail showing a side elevation of a schematic representation of the belt drive and retard system of FIG. 3.

The cooperation between the retard device 56 and belt drive assembly 40 is best shown in FIG. 6 which depicts a schematic representation of the various components of the belt drive assembly and retard device. The six retard members 58–68 each are urged downwardly against the upper run 45 of the belt drive assembly 40 by individual springs 72A–72F, respectively. Each of the retard members 58–68 includes a retard shoe 70 at a lower end thereof which faces the upper run 45. Although the retard members 58–68 are shown abutting one another, this is not necessary for the proper operation of the retard device 56, and the retard members may be spaced such that there are slight gaps between individual members. The springs 72A–72F preferably vary in spring constant so that the spring force urging retard member 58 downwardly in somewhat less than that urging the retard member 60 downwardly, and so on, so that the spring force urging retard member 68 downwardly is the greatest in magnitude. However, it is within the scope of this invention to provide springs 72A–72F which vary in the spring force that they exert on their respective retard members 58–68 in other ways, so that a different force profile may be formed.

With the spring forces varying in the manner illustrated in FIG. 6, fragile documents entering the pinch point 74 are not damaged as a result of the relatively light pressure of element 58 against the leading portion of a sheet. This force can be lighter than for conventional retards without causing multifeed failures, since the subsequent retards exert a sufficient downward force to prevent a multifeed situation. Conversely, the retard member 68 can exert a downward force upon sheets which is greater than that possible with prior art retard devices, without damaging the leading edges of sheets passing beneath it.

In operation, the stack 82 of sheets contacts the retard members 58–68 and the leading edges of the sheets form a wedge shape. Since the frictional forces between the lowermost sheet 106 of the stack 82 and the upper run 45 of the belt 46 exceeds that existing between sheets of the stack, the lowermost sheet is pulled forwardly by the belt as the drive roller 42 rotates. The upper run 45 of the belt 46 is prevented from deflecting from the retard members 58–68 by the backup plate 52.

Another advantage of providing springs 72A–72F with spring constants that increase in the direction of paper travel is that the stiffness of spring 72F for a small displacement may be made equal to or greater than the normal force on element 58 exerted by spring 72A for a relatively large upward displacement, so that the downward force on the lowermost sheet 106 remains constant as it travels beneath the retard device 56. This variation in spring constant eliminates the variation in downward force upon a lowermost sheet 106 by differing stack heights of paper as it enters the retard device 56.

Figure 7:
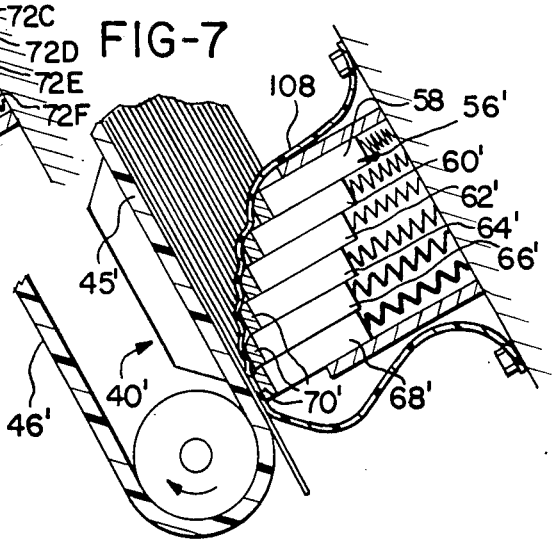
FIG. 7 is a detail showing a side elevation of a schematic representation of the belt drive and retard system of another embodiment of the invention.

An alternate embodiment of the invention is shown schematically in FIG. 7. This device is identical in all respects to that depicted in FIG. 6 except that a sheath 108 is added which encloses the retard elements 58′–68′. Each of the retard shoes 70′ frictionally engages an inner surface of the sheath 108.

Although the sheath 108 may be fabricated to provide different values of coefficients of friction along its length, it is preferable to fabricate the sheath to have a uniform coefficient of friction along its length since this reduces the fabrication costs of the sheath. The sheath 108 is made of a flexible friction material and may be readily replaced when worn, or replaced to substitute a different sheath having a different coefficient of friction.

Figure 8:
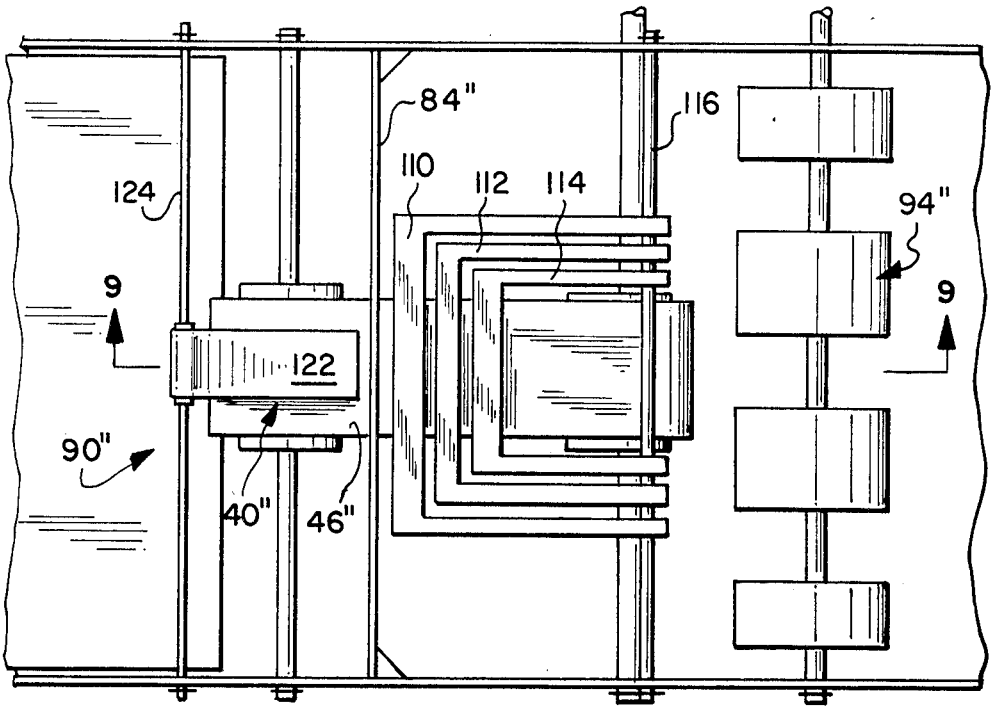
FIG. 8 is a somewhat schematic detail of a top plan view illustrating another embodiment of the invention having a three element drive retard.
Figure 9:
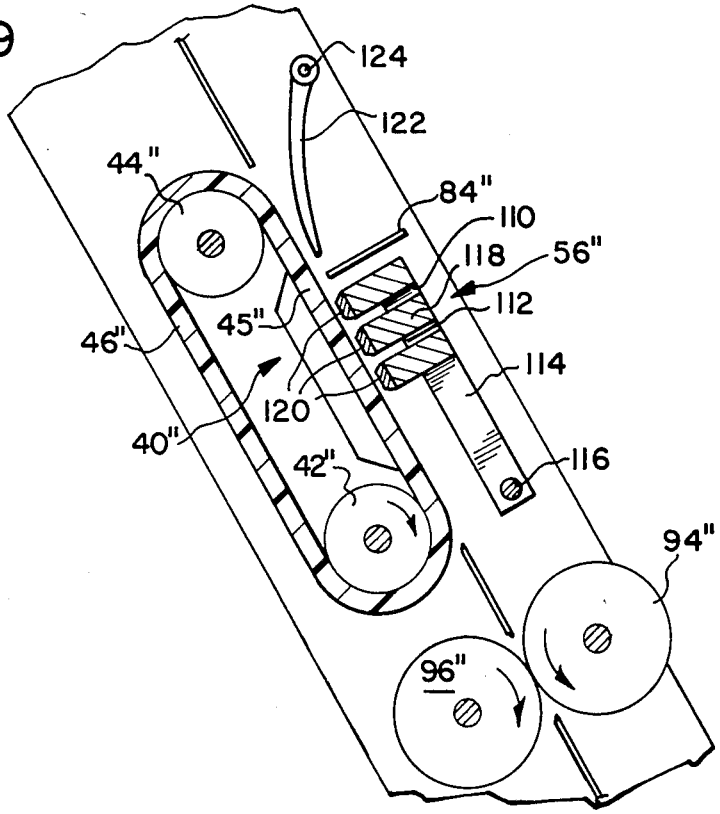
FIG. 9 is a somewhat schematic detail of a side elevation of the embodiment of FIG. 8, taken at line 9—9 of FIG. 8.

A different embodiment of the invention is shown in FIGS. 8 and 9. For documents having reasonably uniform characteristics, it is not necessary to provide a retard device 56 (FIG. 3) having six retard members 58–68. With this embodiment, three retard members 110, 112, 114 are provided, each having a generally U-shape and pivotally attached to a transverse axle 116. Each of the retard elements 110, 112, 114 includes a head 118 having a shoe 120 which faces downwardly and is biased against the upper run 45″ of the belt 46″ of a belt drive assembly 40″.

The retard device 56″ is positioned downstream of a front wall 84″ which extends across the belt 46″. A bail weight 122 is positioned upstream of the wall 84″ and is pivotally mounted to a transverse rod 124.

The location and function of the tray 90″, bail weight 122, front wall 84″ and belt drive assembly 40″ are identical to their counterparts in the embodiment shown in FIGS. 3, 4 and 5. Although the retard members 110, 112, 114 are biased downwardly by their own weights, they may also be biased downwardly by helical springs (not shown) which may be coiled about the axle 116.

For all of the embodiments, a preferred resilient material for the shoes 70, 120 is a soft "rubber" having a durometer rating of about 40. Suitable elastomers include polyurethanes, polyvinylchloride, natural rubber, styrene, butadiene rubber, nitrile rubber, and butyl rubber. The belt 46 preferably combines a molded elastic material on its surface with a woven, nonelastic substrate. A variety of materials may be used as with prior conventional belts. Dacron and rayon cord are examples of suitable substrates. The molded elastic material may be natural or synthetic rubber.

While the forms of apparatus herein described constitute preferred embodiments of this invention, it is to be understood that the invention is not limited to these precise forms of apparatus, and that changes may be made therein without departing from the scope of the invention.

What is claimed is:

1. A sheet feeding device comprising:

downwardly angled tray means for supporting a stack of sheets such that a minimal amount of frictional force is exerted between individual sheets thereof;

a drive belt assembly including an endless drive belt having an upper run extending downwardly from said tray means for conveying sheets therefrom;

a pair of axles extending longitudinally of said belt and on opposite sides thereof;

a plurality of retard members spaced along and above said upper run downstream of said tray means, said retard members being arranged in two intermeshing sets and attached to said axles for independent pivotal movement toward and away from said upper run; and means for independently biasing said retard members downwardly toward said upper run such that sheets from said tray passing beneath said retard members are urged against said upper run by said retard members.

2. The device of claim 1 further comprising bail weight means for urging a forward portion of a stack of sheets against said upper run.

3. The device of claim 2 further comprising front wall means, extending in a direction substantially perpendicular to said upper run, for supporting a stack of sheets in said tray means at leading edges thereof, said front wall means forming a gap with said upper run such that lower sheets of an associated stack may be conveyed therethrough by said drive belt assembly.

4. The device of claim 1 wherein said drive belt and tray means are angled downwardly from the horizontal at an angle between about 50° and about 70°.

5. The device of claim 4 wherein said angle is about 60°.

6. The device of claim 1 wherein said biasing means includes a plurality of coil springs, each associated with a different one of said retard members.

7. The device of claim 6 wherein different ones of said springs have different stiffnesses, said stiffnesses being such as to provide normal forces on said retard members which increase in a direction of sheet travel.

8. The device of claim 1 further comprising a flexible, resilient sheath supported against said retard members and above said upper run.

9. The device of claim 1 further comprising pinch roller means, located downstream of said drive belt assembly, for receiving sheets from said drive belt assembly.

10. The device of claim 9 further comprising means for sensing the presence of a sheet at said pinch roller means; finger means for selectively raising and lowering a forward portion of a stack of sheets in said tray means into and out of engagement, respectively, with said drive belt assembly; and overrunning clutch means for selectively engaging and disengaging said drive belt with motive means for driving said belt; such that a sheet feeding operation may be stopped as a sheet is gripped by said pinch roller means.

11. The device of claim 1 wherein said retard members have a coefficient of friction with paper approximately twice that between sheets of paper, and said belt has a coefficient of friction approximately twice that for said retard members.

12. A sheet feeding device comprising:

tray means for supporting a stack of sheets, said tray means inclined at an angle from the horizontal of about 60° such that a minimal amount of force is exerted between sheets of a supported stack;

drive belt assembly including a forward drive roller, a rearward driven roller located within said tray means, endless belt means extending about said rollers and downwardly from said tray means, said belt means having an upper run extending downwardly and outwardly from a lower portion of said tray means and oriented at an angle from the horizontal of about 60°;

finger means capable of selectively pivoting upwardly to urge a forward portion of a stack in said tray means upwardly from said upper run, or downwardly to allow a forward portion of a stack to engage said upper run;

bail weight means for urging a forward portion of a stack in said tray against said upper run;

front wall means oriented substantially normal to said upper run and forming a gap therewith to allow a plurality of the lowermost sheets therepast;

a plurality of retard members spaced along and above said upper run downstream of said front wall means, each of said retard members including a retard shoe facing said upper run;

a pair of axles extending longitudinally of said belt and on opposite sides thereof, said axles attached to and supporting said retard members in two intermeshing sets;

means for independently biasing each of said retard members downwardly against said upper run such that a biasing force increases in magnitude in a direction of paper travel and said retard members form a pinch point with said upper run;

a back-up plate for supporting said upper run at said pinch point; and said retard shoes each having a coefficient of friction with paper passing therebeneath approximately twice that between sheets of paper, and said belt means having a coefficient of friction with paper passing thereover approximately twice that for said retard shoes.

* * * * *